US010378388B2

(12) United States Patent
Ono et al.

(10) Patent No.: US 10,378,388 B2
(45) Date of Patent: Aug. 13, 2019

(54) EXHAUST HOOD AND ITS FLOW GUIDE FOR STEAM TURBINE

(71) Applicant: Mitsubishi Hitachi Power Systems, Ltd., Nishi-ku, Yokohama (JP)

(72) Inventors: Hideki Ono, Yokohama (JP); Shunsuke Mizumi, Yokohama (JP); Takeshi Kudo, Yokohama (JP); Tatsuhito Hattori, Yokohama (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 253 days.

(21) Appl. No.: 15/403,770

(22) Filed: Jan. 11, 2017

(65) Prior Publication Data

US 2017/0198608 A1 Jul. 13, 2017

(30) Foreign Application Priority Data

Jan. 12, 2016 (JP) ..... 2016-003858

(51) Int. Cl.
*F01D 25/30* (2006.01)
*F01D 5/02* (2006.01)
(Continued)

(52) U.S. Cl.
CPC ..... *F01D 25/30* (2013.01); *F01D 5/02* (2013.01); *F01D 5/12* (2013.01); *F01D 9/04* (2013.01);
(Continued)

(58) Field of Classification Search
CPC ..... F01D 25/30; F01D 25/25; F05D 2250/20
(Continued)

(56) References Cited

U.S. PATENT DOCUMENTS 5,518,366 A * 5/1996 Gray ..... F01D 25/30 415/211.2
8,632,304 B2 * 1/2014 Sweetland ..... F01D 9/026 415/204

(Continued)

FOREIGN PATENT DOCUMENTS

EP 1 921 278 A1 5/2008
JP 2014-5813 A 1/2014
WO WO-2015084030 A1 * 6/2015 ..... F04D 29/544

OTHER PUBLICATIONS

Extended European Search Report issued in counterpart European Application No. 17150945.8 dated May 11, 2017 (Seven (7) pages).

*Primary Examiner* — Jason D Shanske
*Assistant Examiner* — Andrew Thanh Bui
(74) *Attorney, Agent, or Firm* — Crowell & Moring LLP

(57) ABSTRACT

An exhaust hood for a steam turbine includes a bearing cone; an annular flow guide; and an external casing surrounding the bearing cone and the flow guide. Meridional shapes of the flow guide at respective circumferential positions are shapes obtained by rotating one representative shape around an upstream end of the representative shape in a meridional plane and by reducing or maintaining a radial length of the representative shape. A circumferential distribution of inclination angles of an upstream end of the flow guide with respect to a center axis of a turbine rotor of the steam turbine has representative inclination angles at respective representative positions in the circumferential direction. The circumferential distribution between the representative positions is defined by a linear interpolation. Each representative position is a position where the inclination angles change from increasing or decreasing to decreasing or increasing, or from constant to increasing or decreasing.

4 Claims, 6 Drawing Sheets

(51) Int. Cl.
*F01D 5/12* (2006.01)
*F01D 9/04* (2006.01)

(52) U.S. Cl.
CPC ..... *F05D 2220/31* (2013.01); *F05D 2250/52* (2013.01)

(58) Field of Classification Search
USPC ..... 415/220, 223
See application file for complete search history.

(56) References Cited

U.S. PATENT DOCUMENTS

| | | | | |
|---|---|---|---|---|
| 9,822,801 | B2 * | 11/2017 | Nakagawa | F04D 29/544 |
| 2008/0063516 | A1 | 3/2008 | Fridsma | |
| 2012/0171010 | A1 * | 7/2012 | Chevrette | F01D 25/24 415/1 |
| 2012/0183397 | A1 | 7/2012 | Mizumi et al. | |
| 2015/0063992 | A1 | 3/2015 | Noguchi et al. | |

* cited by examiner

EXHAUST HOOD AND ITS FLOW GUIDE FOR STEAM TURBINE

BACKGROUND OF THE INVENTION

Field of the Invention

The present invention relates to a flow guide configuring a part of a diffuser flow path of an exhaust hood for a steam turbine and an exhaust hood of a steam turbine including the flow guide.

Background Art

A power plant that generates power by rotating turbines with steam generated by a steam generator such as a boiler is generally configured of a plurality of turbines in accordance with a steam pressure such as a high pressure turbine, an intermediate pressure turbine, and a low pressure turbine. The steam generated by the steam generator completes a rotation operation by passing through the high pressure turbine to the low pressure turbine in order and is introduced into a condenser. The steam is condensed and becomes condensed water in there, and is returned to the steam generator. A steam flow path called as an exhaust chamber is provided immediately after an outlet of each of the high pressure, the intermediate pressure, and the low pressure turbines. The exhaust chamber generally has a shape that causes sharp turns of a flow, and a pressure loss is therefore likely to occur due to resistance to a steam flow in the exhaust chamber.

In the power plants having such a configuration, there is a downward-discharging type power plant in which the condenser is disposed below the low pressure turbine. The downward-discharging type power plant enables a building for housing the power plant to be downsized. In the exhaust chamber of the low pressure turbine in the downward-discharging type power plant, steam discharged from the low pressure turbine is turned downward to the condenser at a short distance. Therefore, the steam is not smoothly turned and separation occurs in a flow of the steam thereby causing a pressure loss. The pressure loss in the exhaust chamber of the low pressure turbine that is the steam flow path from the outlet of the low pressure turbine to the condenser greatly affects a plant performance. It is effective in improvement of the plant performance if the pressure loss is reduced.

A diffuser flow path structure, of which a flow path cross-sectional area is gradually increased toward a downstream side, is employed in many exhaust chambers of the low pressure turbines. Converting a kinetic energy of the steam into pressure energy by smoothly expanding the steam in the diffuser flow path is called as a diffuser effect. If the diffuser effect is effectively exhibited, an outlet pressure of the low pressure turbine is lowered. Consequently, heat drop of the steam between an inlet and the outlet of the low pressure turbine is increased and it is possible to obtain a higher output.

In general, the diffuser flow path is formed of an annular member that is called as a flow guide mounted on an outlet portion of a final stage of the turbine, a wall surface (member for covering a bearing that is called as a bearing cone) on a bearing side that is positioned inside the flow guide, and the like. The improvement of the diffuser effect is achieved particularly by devising various shapes of the flow guide. An exhaust chamber having such a diffuser flow path is disclosed, for example, in JP-A-2014-5813. JP-A-2014-5813 discloses a flow guide employed to exhibit a high diffuser effect and to improve the plant efficiency at low cost without changing manufacturing and assembling accuracy in a current situation. In the flow guide, guide surfaces of an upper half side and a lower half side of the flow guide are respectively configured of curved surfaces formed by rotating curved lines having shapes different from each other around a rotor axis, and a gap horizontally formed in a connecting portion of the upper half side and the lower half side is closed by a closing member.

In the exhaust chamber of the downward-discharging type steam turbine, it is possible to improve turbine performance by improvement of the diffuser effect of the flow guide, that is, improvement of a pressure recovery rate. Since the flow of the diffuser flow path is vertically asymmetrical, a shape of the flow guide to maximize a pressure recovery coefficient of the exhaust chamber is different on upper and lower sides.

If the entire flow guide is formed in an optimal shape to maximize the pressure recovery coefficient, a manufacturing cost is high. In general, the flow guide is annularly formed by integrating a plurality of segments divided in a circumferential direction by welding or the like. The plurality of segments are shaped in desired shapes by plate working such as bending. In a case where the flow guide has a rotationally symmetric shape, the plurality of segments forming the flow guide have the same shape, and one die is therefore sufficient for plate working. In contrast, in a case where the flow guide has an ideal optimal shape with different curvature radii at respective positions in the circumferential direction, the plurality of segments forming the flow guide have different shapes from each other, and a plurality of dies are therefore necessary for plate working. For example, in a case where the flow guide is configured by being divided into eight in the circumferential direction, eight dies are necessary for plate working. It requires eight times the number of the dies in the case of the rotationally symmetrical flow guide, and there is a problem that the manufacturing cost is increased.

In the related art, a flow guide in consideration of a balance between the manufacturing cost and the performance has been used. That is, the flow guide has a shape having a curved surface with a single curvature in the entire circumference and having radial lengths different in the circumferential direction (on an upper half side and lower half side) according to the shape of the exhaust chamber and the like. As the shape of the curved surface of the flow guide, an intermediate shape of optimal shapes of the upper half side and the lower half side of the flow guide is employed. Therefore, it is possible to manufacture the flow guide at a low cost, but there is a compromise on the pressure recovery coefficient of the exhaust chamber. In the exhaust chamber of the low pressure turbine described in JP-A-2014-5813 described above, the guide surfaces of the upper half side and the lower half side of the flow guide are formed by the curved surfaces obtained by rotating the curved lines around the rotor axis and a connection portion between the guide surface of the upper half side and the guide surface of the lower half side is discontinuous. Therefore, there is room for improvement of the pressure recovery coefficient.

SUMMARY OF THE INVENTION

The invention is made to solve the problem described above and an object thereof is to provide a flow guide of an exhaust hood for a steam turbine and an exhaust hood for a steam turbine in which both a high diffuser effect and a low manufacturing cost can be achieved.

In order to solve the problem described above, for example, configurations described in claims are employed.

According to an aspect of the present invention, there is provided an exhaust hood for a steam turbine. The steam turbine includes: a turbine rotor that is rotatable around a center axis; and a plurality of moving blades disposed on an outer periphery side of the turbine rotor. The exhaust hood includes: a bearing cone disposed on an inner periphery side and on a downstream side of the moving blades of a final stage; an annular flow guide disposed on an outer periphery side and on the downstream side of the moving blades of the final stage; and an external casing surrounding the bearing cone and the flow guide. Meridional shapes of the flow guide at respective circumferential positions are shapes obtained by rotating a certain representative shape around an upstream end of the certain representative shape in a meridional plane and by equally maintaining or reducing a radial length of the certain representative shape. A circumferential distribution of inclination angles of the upstream end of the flow guide with respect to an axial direction of the turbine rotor has representative inclination angles at respective representative positions in the circumferential direction. The circumferential distribution of the inclination angles between the representative positions is defined by a linear interpolation using the representative inclination angles at the representative positions.

According to the invention, the flow guide has a shape such that the meridional shapes of the flow guide are continuously changed in the circumferential direction and portions of the flow guide between the representative positions in the circumferential direction can be shaped by the same die for plate working even if the portions of the flow guide are divided into several segments in the circumferential direction. Therefore, both a high diffuser effect and a low manufacturing cost can be achieved.

Problems, configurations, and effects other than those described above will become apparent from the following description of embodiments.

DETAILED DESCRIPTION OF THE INVENTION

Hereinafter, flow guides of an exhaust hood for a steam turbine and exhaust hoods for a steam turbine according to embodiments of the invention will be described with reference to the drawings.

First Embodiment

First, a configuration of a flow guide of an exhaust hood for a steam turbine and an exhaust hood for a steam turbine according to a first embodiment of the invention will be described with reference to FIGS. 1 and 2.

Figure 1:
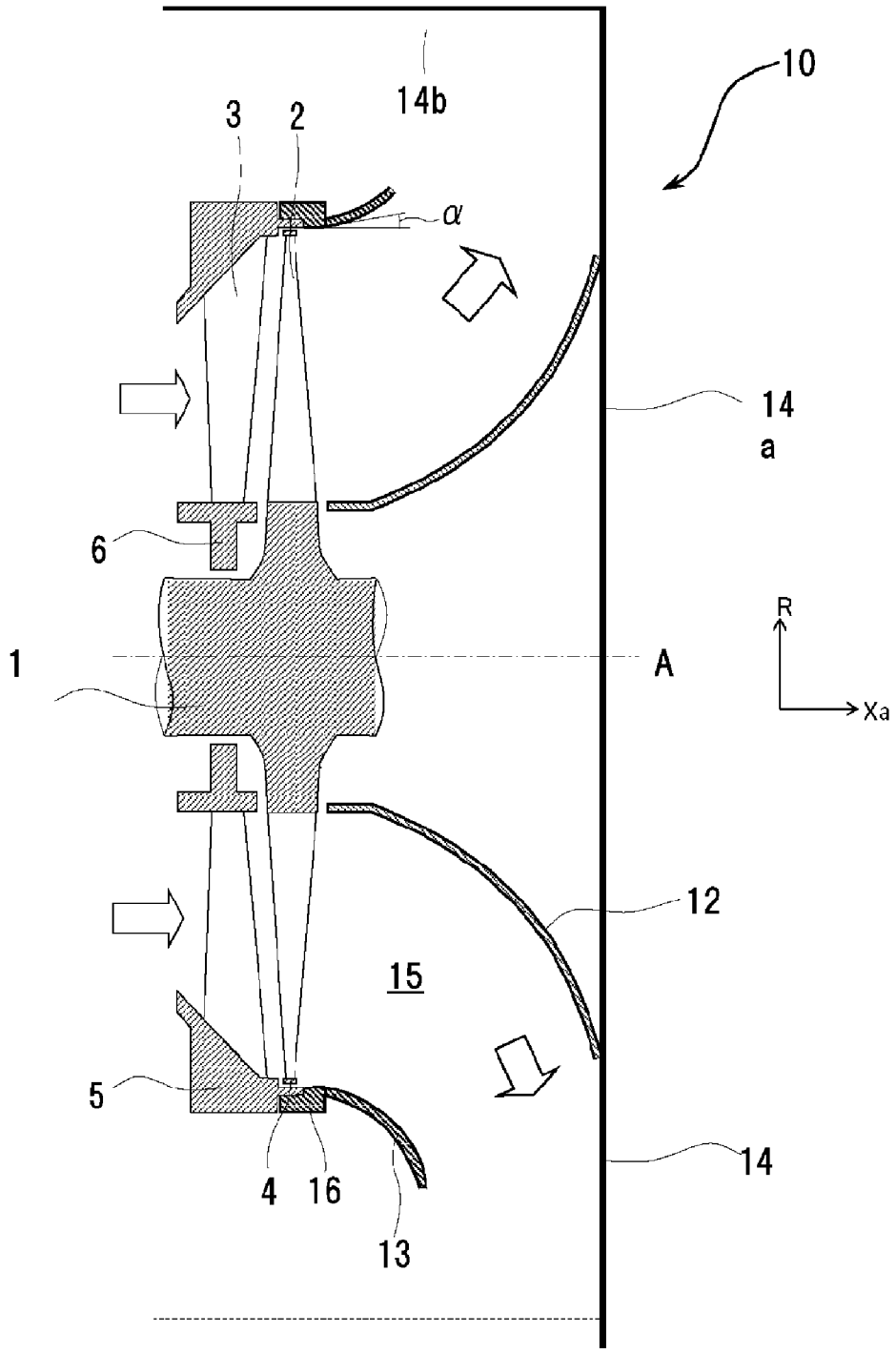
FIG. 1 is a schematic vertical sectional view illustrating a flow guide of an exhaust hood for a steam turbine and an exhaust hood for a steam turbine according to a first embodiment of the present invention with a final stage of the steam turbine.

FIG. 1 is a schematic vertical sectional view illustrating the flow guide of the exhaust hood for the steam turbine and the exhaust hood for the steam turbine according to the first embodiment of the invention with a final stage of the steam turbine. FIG. 2 is a perspective view illustrating the flow guide of the exhaust hood for the steam turbine according to the first embodiment of the invention illustrated in FIG. 1. In FIG. 1, white arrows indicate a flow of steam. In FIGS. 1 and 2, arrow Xa indicates an axial direction (direction of a center axis) of a turbine rotor, arrow R indicates a radial direction of the turbine rotor, and θ indicates a circumferential position (angle).

In FIG. 1, the steam turbine includes a turbine rotor 1 that is rotatable around a center axis A, a plurality of moving blades 2 (two in FIG. 1) that are disposed on an outer periphery side and in the circumferential direction of the turbine rotor 1, and a plurality of nozzle blades 3 (two in FIG. 1) that are disposed in the circumferential direction to face the moving blades 2 on an upstream side. The nozzle blades 3 and the moving blades 2 disposed in the circumferential direction are alternately disposed in the axial direction Xa (horizontal direction in FIG. 1) of the turbine rotor 1 and configure a plurality of stages (only a final stage is illustrated in FIG. 1). The moving blade 2 has a cover 4 at a tip portion thereof to reduce a leakage flow on an outer periphery side thereof. The nozzle blade 3 is held by a nozzle diaphragm outer ring 5. A nozzle diaphragm inner ring 6 is provided at a tip of the nozzle blade 3 on an inner periphery side to reduce a leakage flow due to a pressure difference between a front and a rear of the nozzle blade 3. Steam as a working fluid passes through the nozzle blades 3 and the moving blades 2 of the final stage of the steam turbine and drives the turbine rotor 1.

The steam turbine is, for example, a downward-discharging type and further includes an exhaust hood 10 that guides exhaust gas after driving the turbine rotor 1 to a condenser (not illustrated) disposed below the steam turbine. The exhaust hood 10 includes an internal casing (not illustrated) that encloses the turbine rotor 1 and the moving blades 2, a bearing cone 12 that is disposed on a downstream side and on an inner periphery side (root side) of the moving blades 2 of the final stage, an annular flow guide 13 that is disposed on the downstream side and on an outer periphery side (tip side) of the moving blades 2 of the final stage, and an external casing 14 that surrounds the internal casing, the bearing cone 12, and the flow guide 13. The bearing cone 12 is an annular member that is disposed to surround a bearing (not illustrated) on the turbine rotor 1, and a downstream end of the bearing cone 12 is connected to an axial end wall 14*a* of the external casing 14. An annular diffuser flow path 15 is formed on the downstream side of the moving blades 2 of the final stage by the bearing cone 12, the flow guide 13, and the axial end wall 14*a* of the external casing 14. A Flow path cross-sectional area of the diffuser flow path 15 is gradually enlarged toward a downstream side in a flow direction of the exhaust gas. The diffuser flow path 15 converts a kinetic energy to a pressure by slowing the exhaust gas discharged from the moving blades 2 of the final stage and achieves pressure recovery of the exhaust gas. The diffuser flow path 15 discharges the exhaust gas outward in the radial direction R from an outlet of the moving blades 2 of the final stage.

The flow guide 13 is attached to, for example, a flow guide ring 16 by welding or the like and is fixed to the nozzle diaphragm outer ring 5 via the flow guide ring 16. As illustrated in FIGS. 1 and 2, an upstream end (mounting portion on the flow guide ring 16) of the flow guide 13 is curved outward in the radial direction R so as to be inclined with an inclination angle $\alpha$ with respect to the axial direction Xa. The inclination angle $\alpha$ is an angle between the axial direction Xa and a tangential line on the inner peripheral surface of the upstream end. As illustrated in FIG. 2, the annular flow guide 13 is formed by a plurality of curved segments 18 divided in the circumferential direction and the curved segments 18 are integrated by welding or the like.

Next, a detailed shape of the flow guide of the exhaust hood for the steam turbine according to the first embodiment of the invention will be described by comparing to a shape of a flow guide of an exhaust hood for a steam turbine of the related art.

Figure 3:
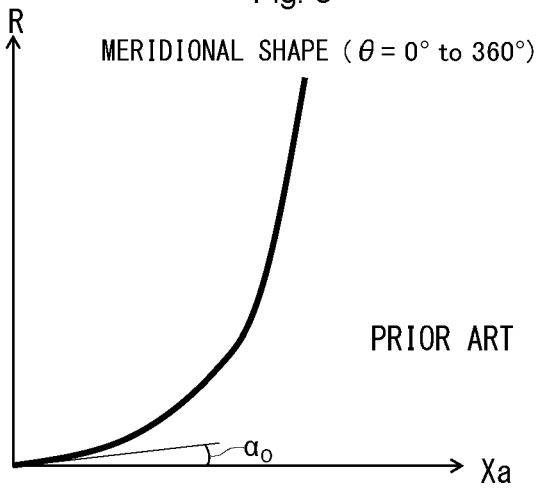
FIG. 3 is a schematic diagram illustrating an example of a meridional shape of a flow guide of an exhaust hood for a steam turbine of the related art.
Figure 4:
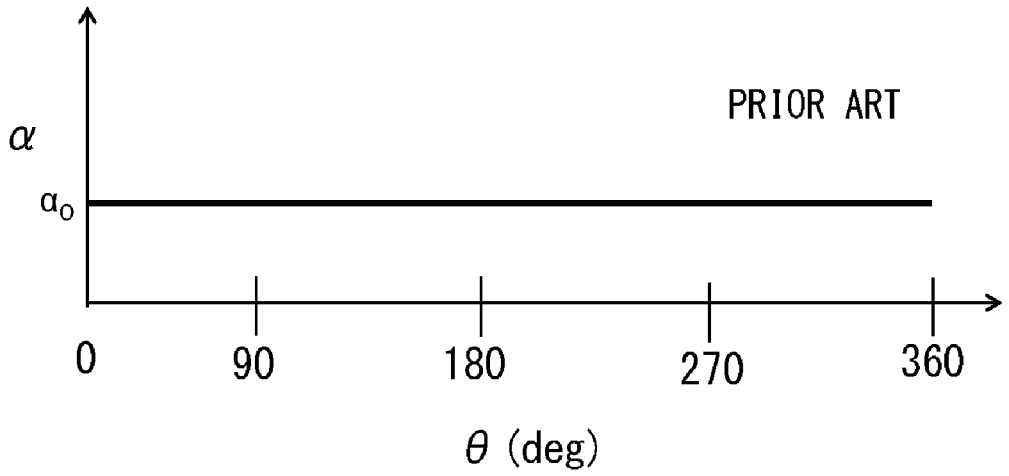
FIG. 4 is a diagram illustrating a circumferential distribution of inclination angles of the flow guide of the exhaust hood for the steam turbine of the related art.
Figure 5:
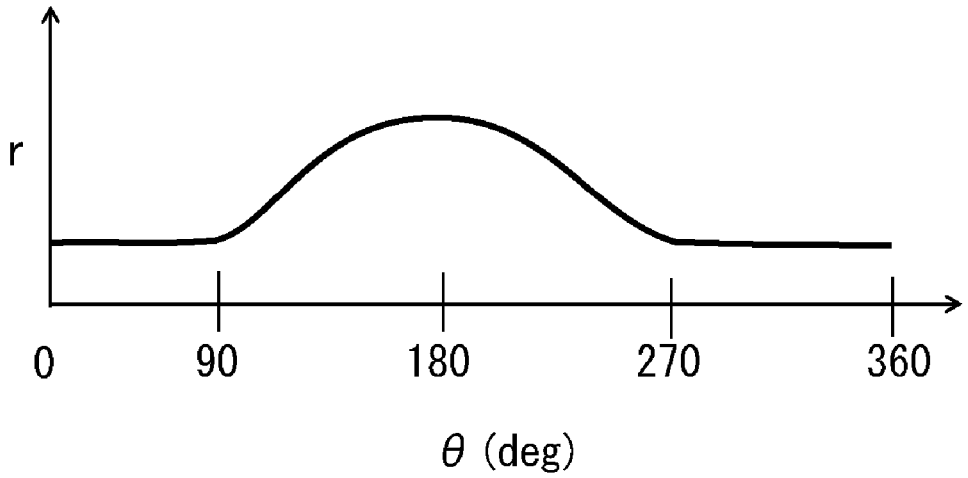
FIG. 5 is a diagram illustrating a circumferential distribution of radial lengths of the flow guide of the exhaust hood for the steam turbine of the related art.

First, the shape of the flow guide of the exhaust hood for the steam turbine of the related art will be described with reference to FIGS. 2 to 5. FIG. 3 is a schematic diagram illustrating an example of a meridional shape of the flow guide of the exhaust hood for the steam turbine of the related art. FIG. 4 is a diagram illustrating a circumferential distribution of inclination angles of the flow guide of the exhaust hood for the steam turbine of the related art. FIG. 5 is a diagram illustrating a circumferential distribution of radial lengths of the flow guide of the exhaust hood for the steam turbine of the related art. In FIG. 4, a vertical axis $\alpha$ indicates the inclination angle of the upstream end of the flow guide with respect to the axial direction and a horizontal axis $\theta$ indicates a circumferential position in the flow guide. In FIG. 5, a vertical axis r indicates the radial length of the flow guide and a horizontal axis $\theta$ indicates the circumferential position in the flow guide. In FIGS. 3 to 5, the same reference numerals as those illustrated in FIGS. 1 and 2 indicate the same portions, and detailed description thereof will be therefore omitted.

Figure 2:
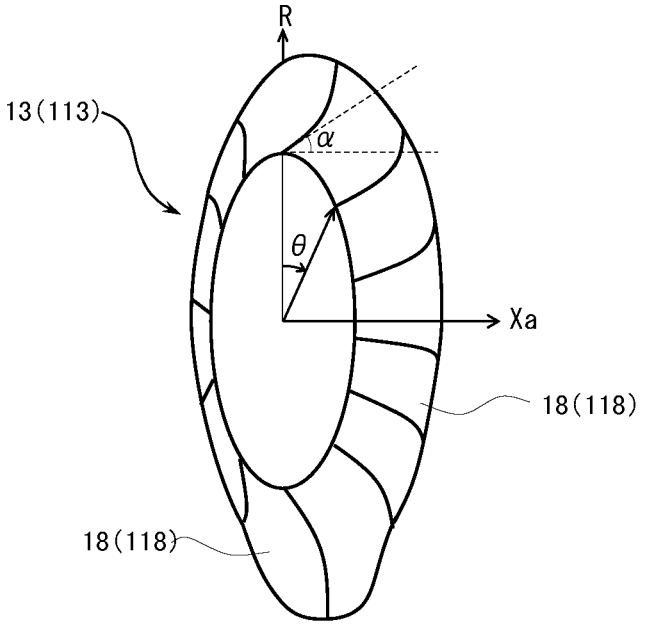
FIG. 2 is a perspective view illustrating the flow guide of the exhaust hood for the steam turbine according to the first embodiment of the present invention illustrated in FIG. 1.

As illustrated in FIG. 2, similar to the flow guide 13 according to the first embodiment, a flow guide 113 of the related art is annularly formed by integrating a plurality of curved segments 118 by welding or the like. The curved segments 118 are shaped by plate working such as bending. In order to reduce a manufacturing cost, the flow guide 113 has a shape such that all the curved segments 118 forming the flow guide 113 can be shaped by one die.

Specifically, as illustrated in FIG. 3, the flow guide 113 is shaped such that meridional shapes (cross-sectional shapes in a surface containing the center axis A) of the flow guide 113 overlap in an entire circumference ($\theta$=0° to 360°). As illustrated in FIGS. 3 and 4, the inclination angles $\alpha$ of the upstream end of the flow guide 113 illustrated in FIG. 2 have the same value $\alpha_0$ in the entire circumference ($\theta$=0° to 360°). As illustrated in FIG. 5, the flow guide 113 is shaped such that lengths r of the meridional shapes in the radial direction R are constant in an upper half portion ($\theta$=0° to 90° and 270° to 360°) and are distributed greater in a lower half portion ($\theta$=90° to 270°) than those in the upper half portion. That is, the flow guide 113 of the related art is formed such that lengths r in the radial direction R of a shape obtained by rotating the meridional shape illustrated in FIG. 3 around the center axis A (see FIG. 1) vary according to the circumferential positions $\theta$.

The reason that the lengths r of the flow guide 113 in the radial direction R are distributed as described above is as follows. A shape of an upper-side outlet of the flow guide 113 is limited by a shape of a side wall surface 14*b* (see FIG. 1) positioned on the outer periphery side of the external casing 14 (see FIG. 1). For example, in a case where the length r of an upper side of the flow guide 113 in the radial direction R is excessive, a throttle flow path is formed between the flow guide 113 and the external casing 14. Pressure recovery of the exhaust gas is therefore inhibited and a turbine output is reduced. In contrast, a downstream side of a lower side of the flow guide 113 is a portion connected to a condenser (not illustrated) and there is no structure that blocks the diffuser flow path 15 (see FIG. 1). Therefore, if an optimal diffuser flow path to maximize the pressure recovery coefficient is formed by the lower side of the flow guide 113 and the axial end wall 14*a* (see FIG. 1) of the external casing 14, it is necessary to increase the length r of the lower side of the flow guide 113 in the radial direction R more than that of the upper side. That is, under the premise that the meridional shapes of the flow guide 113 at respective circumferential positions $\theta$ overlap and the inclination angles $\alpha$ of the upstream end of the flow guide 113 at respective circumferential positions $\theta$ are constant, the circumferential distribution of the lengths r of the flow guide 113 in the radial direction R is optimized such that the pressure recovery of the exhaust hood is maximized.

In a case where the flow guide 113 having the shape described above is employed, the lengths r of the flow guide 113 in the radial direction R vary according to the positions $\theta$ in the circumferential direction, but the plurality of curved segments 118 forming the flow guide 113 can be shaped by one die. Therefore, it is possible to achieve reduction of the manufacturing cost. However, in the flow guide 113 of the related art in which a curved surface shape obtained by rotating a certain curved line around the center axis A is a base shape, there is a compromise on the pressure recovery coefficient of the diffuser flow path. Therefore, a flow guide with improved pressure recovery coefficient is required.

Next, a detailed shape of the flow guide of the exhaust hood for the steam turbine according to the first embodiment of the invention will be described with reference to FIGS. 2, 5 to 7.

Figure 6:
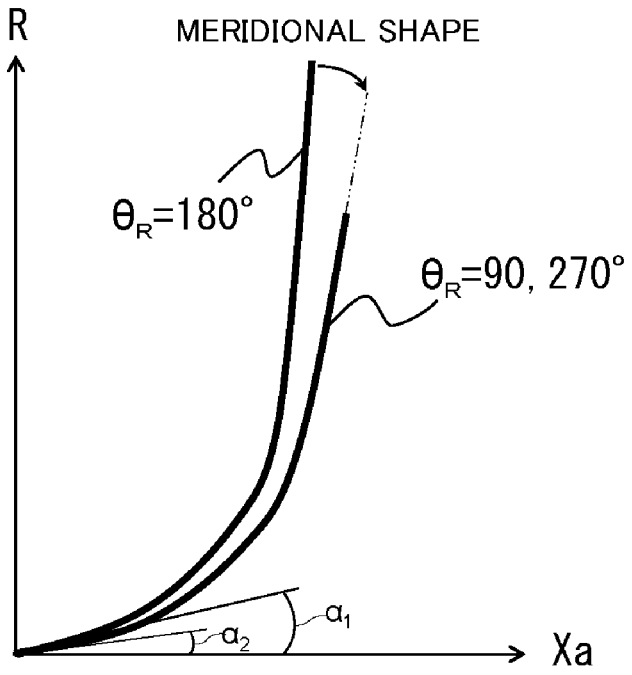
FIG. 6 is a schematic diagram illustrating an example of meridional shapes at circumferential representative positions of the flow guide of the exhaust hood for the steam turbine according to the first embodiment of the present invention illustrated in FIG. 2.
Figure 7:
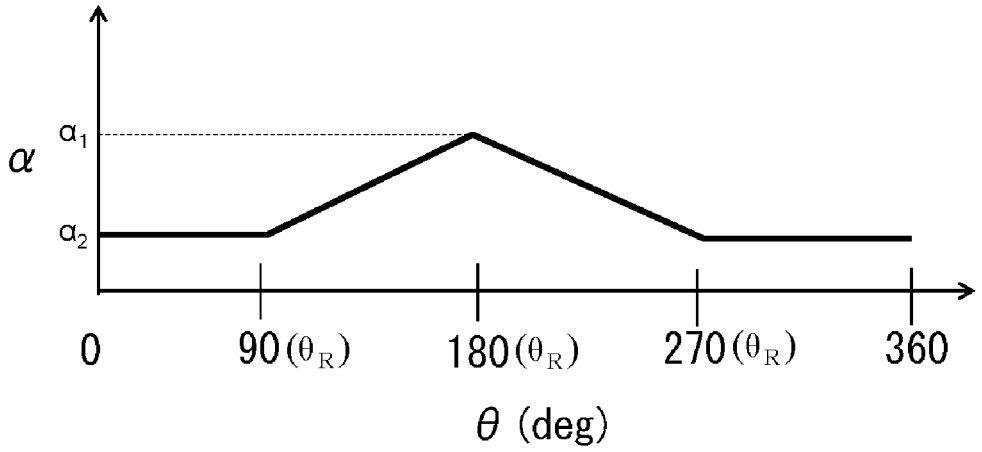
FIG. 7 is a diagram illustrating a circumferential distribution of inclination angles of the flow guide of the exhaust hood for the steam turbine according to the first embodiment of the present invention illustrated in FIG. 2.

FIG. 6 is a schematic diagram illustrating an example of meridional shapes at circumferential representative positions of the flow guide of the exhaust hood for the steam turbine according to the first embodiment of the invention illustrated in FIG. 2. FIG. 7 is a diagram illustrating a circumferential distribution of inclination angles of the flow guide of the exhaust hood for the steam turbine according to the first embodiment of the invention illustrated in FIG. 2. In FIG. 7, a vertical axis $\alpha$ indicates the inclination angle of the upstream end of the flow guide with respect to the axial direction and a horizontal axis $\theta$ indicates the circumferential position in the flow guide. In FIGS. 6 and 7, the same reference numerals as those illustrated in FIGS. 1 to 5 indicate the same portions, and detailed description thereof will be therefore omitted.

The meridional shapes of the flow guide 13 illustrated in FIG. 2 at respective positions $\theta$ in the circumferential direction are shapes that are obtained by rotating a representative shape, which is a meridional shape at a certain circumferential position, around the upstream end of the representative shape in a meridional plane and by equally maintaining or reducing a radial length of the representative shape. Specifically, as illustrated in FIG. 6, a meridional shape at the circumferential position $\theta$ of 180° (center of lower half portion) is set in a shape suitable for improving the pressure recovery coefficient of the diffuser flow path 15 (see FIG. 1), for example, a shape defined by a free curved line. The meridional shape is defined as the representative shape. Meridional shapes at the circumferential positions $\theta$ of 90° and 270° (boundary portions between the upper half portion and the lower half portion in FIG. 2) are shapes (shape indicated by a solid line in FIG. 6) that are obtained by rotating (state of being indicated by a two-dotted chain line in FIG. 6) the representative shape around the upstream end of the representative shape in a direction approaching the axial direction Xa by an angle in the meridional plane and by reducing the length r in the radial direction R of the representative shape. Meridional shapes of a portion (upper half portion) from the circumferential positions $\theta$ of 0° to 90° and 270° to 360° are the same as each other. Meridional shapes of a portion (lower half portion) from the circumferential positions $\theta$ of 90° to 270° are continuously changed in the circumferential direction.

In addition, the flow guide 13 illustrated in FIG. 2 is shaped such that the inclination angles $\alpha$ at respective positions $\theta$ in the circumferential direction are distributed as illustrated in FIG. 7. Specifically, the inclination angles $\alpha$ of the upper half portion ($\theta$=0° to 90° and 270° to 360°) of the flow guide 13 have a constant value $\alpha_2$. The inclination angles $\alpha$ of the lower half portion ($\theta$=90° to 270°) of the flow guide 13 are greater than those of the upper half portion ($\theta$=0° to 90° and 270° to 360°), and the inclination angle $\alpha$ at the circumferential position $\theta$ in the direction of 180° (center of the lower half portion) is a maximum value $\alpha_1$. Among the inclination angles $\alpha$ of the lower half portion, the inclination angles $\alpha$ of a portion (right side portion connected to the upper half portion from the center of the lower half portion viewed from the downstream side in FIG. 2) from the circumferential positions $\theta$ of 180° to 90° and the inclination angles $\alpha$ of a portion (left side portion connected to the upper half portion from the center of the lower half portion viewed from the downstream side in FIG. 2) from the circumferential positions $\theta$ of 180° to 270° are each defined by a linear interpolation using the inclination angles ($\alpha_1$, $\alpha_2$) at both ends (at 180° and 90° or at 180° and 270°) of the portions. That is, the circumferential distribution of the inclination angles $\alpha$ of the flow guide 13 has representative inclination angles ($\alpha_1$, $\alpha_2$) at respective representative positions $\theta_R$ (180°, 90°, and 270°) in the circumferential direction. The representative inclination angles ($\alpha_1$, $\alpha_2$) are set to angles at which the pressure recovery coefficient of the exhaust hood 10 is improved according to the shape of the external casing 14 (see FIG. 1). The distribution of the inclination angles $\alpha$ of the flow guide 13 between the representative positions $\theta_R$ in the circumferential direction is defined by the linear interpolation using the representative inclination angles ($\alpha_1$, $\alpha_2$) at the representative positions $\theta_R$ (180°, 90°, and 270°). However, the representative positions $\theta_R$ are not limited to 180°, 90°, and 270°, and may be set to various positions according to needs of a design or the like.

Furthermore, the flow guide 13 is shaped such that, for example, the lengths r of the meridional shapes in the radial direction R are distributed similar to those of the flow guide 113 of the related art illustrated in FIG. 5. That is, the lengths r of the meridional shapes in the radial direction R are constant in the upper half portion ($\theta$=0° to 90° and 270° to 360°) of the flow guide 13 and are distributed greater in the lower half portion ($\theta$=90° to 270°) than those in the upper half portion. The lengths r of the lower half portion in the radial direction R have the maximum at the circumferential position $\theta$ of 180° (center of the lower half portion) and the lengths r of the lower half portion in the radial direction R are distributed to be monotonically decreased from the circumferential position $\theta$ of the center of the lower half portion toward the upper half portion.

The inner peripheral surface (curved guide surface) of the flow guide 13 having such a configuration has a circumferentially continuous shape at any position $\theta$ in the circumferential direction. The portion (upper half portion) of the flow guide 13 from the circumferential position $\theta$ of 0° to 90° and 270° to 360° has a smooth curved shape of which a first-order differential is continuous at any position $\theta$ in the circumferential direction excluding the both ends (90° and 270°). The portion (right side portion connected to the upper half portion from the center of the lower half portion viewed from the downstream side in FIG. 2) from the circumferential positions $\theta$ of 90° to 180° and the portion (left side portion connected to the upper half portion from the center of the lower half portion viewed from the downstream side in FIG. 2) from the circumferential positions $\theta$ of 180° to 270° each have smooth curved shapes of which first-order differentials are continuous at any position $\theta$ in the circumferential direction excluding the both ends (90° and 180° or 180° and 270°). That is, the inner peripheral surface of the flow guide 13 is a smooth curved shape in the circumferential direction excluding portions at the representative positions $\theta_R$ (90°, 180°, and 270°) in the circumferential direction.

In a case where the flow guide 13 is manufactured by plate working, it is possible to form the flow guide 13 with total three dies. In the upper half portion ($\theta$=0° to 90° and 270° to 360°) of the flow guide 13, the meridional shapes thereof are the same at respective positions $\theta$ in the circumferential direction. Therefore, the upper half portion can be manufactured by one die even if the upper half portion is configured by being divided into several segments in the circumferential direction. In addition, the inclination angles of the portion between the circumferential positions $\theta$ of 90° and 180° as the representative positions $\theta_R$ and the portion between the circumferential positions $\theta$ of 180° and 270° as the representative positions $\theta_R$ in the flow guide 13 are each defined by the linear interpolation using the representative inclination angles ($\alpha_1$, $\alpha_2$) at the representative positions $\theta_R$ (180° and 90° or 180° and 270°). Therefore, each of the portions between the representative positions $\theta_R$ (90° and 180° or 180° and 270°) of the flow guide 13 can be formed by one die even if each of the portions is configured by being divided into several segments in the circumferential direction. Accordingly, the flow guide 13 can be formed by three dies for plate working.

As described above, in the present embodiment, the upper half portion and the lower half portion of the flow guide 13 have an asymmetrical shape such that the pressure recovery coefficient of the exhaust hood 10 is improved, and the flow guide 13 has a continuous shape in the circumferential direction. Therefore, it is possible to obtain the exhaust hood 10 in which the pressure recovery coefficient is improved more than that of the flow guide of the related art which has a shape obtained by being rotated around the center axis A as a base shape.

In addition, in the present embodiment, it is possible to greatly reduce the manufacturing cost of the flow guide 13 having the shape described above compared to a case where a flow guide of an optimal shape having curvature radii different at respective position θ in the circumferential direction is formed. For example, in a case where the flow guide divided into eight segments in the circumferential direction is manufactured, the number of dies for plate working necessary for forming the flow guide 13 according to the present embodiment is three while the number of dies for plate working necessary for forming the flow guide of the optimal shape is eight.

Figure 8:
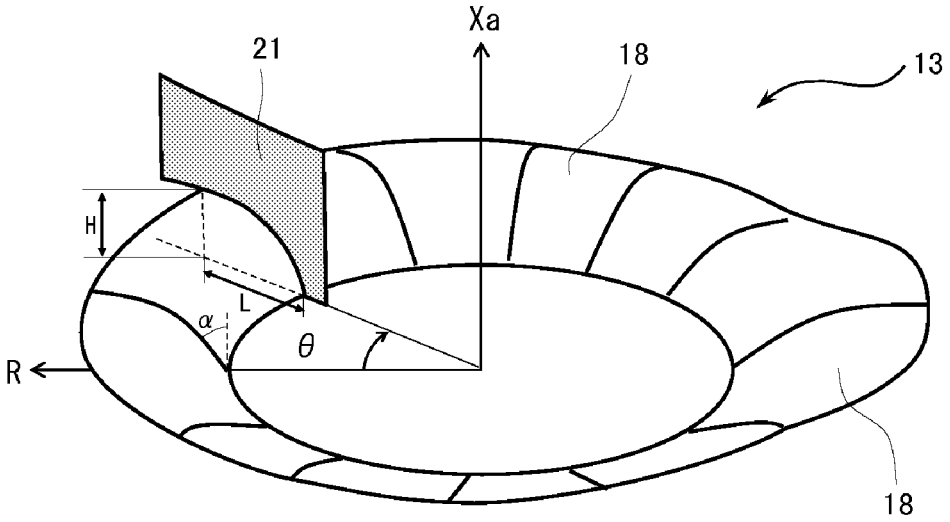
FIG. 8 is an explanatory view illustrating a method for inspecting a shape of the flow guide of the exhaust hood for the steam turbine according to the first embodiment of the present invention.

Next, a method for inspecting the shape of the flow guide of the exhaust hood for the steam turbine according to the first embodiment of the invention will be described with reference to FIG. 8. FIG. 8 is an explanatory view illustrating a method for inspecting the shape of the flow guide of the exhaust hood for the steam turbine according to the first embodiment of the invention. In FIG. 8, arrow Xa indicates the axial direction, arrow R indicates the radial direction, and θ indicates the circumferential position. In FIG. 8, the same reference numerals as those illustrated in FIGS. 1 to 7 indicate the same portions, and detailed description thereof will be therefore omitted.

In the inspection of the curved guide surface (inner peripheral surface) of the flow guide 13, the flow guide 13 is disposed on a horizontal plane with the upstream side of the flow guide 13 facing downward, a flow guide inspection gauge 21 is abutted against the curved guide surface, and thereby a shape of the curved guide surface at respective positions θ in the circumferential direction is confirmed. In the flow guide 13, the meridional shapes at respective positions θ in the circumferential direction are the shapes obtained by rotating the certain representative shape around the upstream end of the representative shape on the meridional plane (see FIG. 6). Therefore, it is possible to perform the shape inspection of the curved guide surface at respective positions θ in the circumferential direction by using one flow guide inspection gauge 21 corresponding to the curved guide surface of the representative shape.

In the flow guide 13, since the inclination angles α are not the same through the entire circumference, it is necessary to confirm the inclination angles α at respective positions θ in the circumferential direction. However, it is difficult to directly measure the inclination angles α. Therefore, a horizontal distance L and a vertical distance H between the upstream end and the downstream end of the flow guide 13 are each measured at respective positions θ in the circumferential direction, the measured values and designed values are compared, and thereby the inclination angles α at respective circumferential positions θ is indirectly confirmed.

In a case where the flow guide having an optimal shape with a different curvature radius at each position θ in the circumferential direction is inspected, it is necessary to use inspection gauges having shapes corresponding to curved guide surfaces at respective circumferential positions θ. That is, it is necessary to prepare various inspection gauges, and thus a manufacturing cost of the gauges is increased. In addition, it is necessary to inspect the flow guide using a corresponding inspection gauge at each circumferential position θ. Therefore, the inspection is complicated, and it becomes a factor of an increase in a shape inspection cost due to a long period of time of an inspection time.

In the present embodiment, it is possible to confirm the shape of the curved guide surface of the flow guide 13 in the entire circumference by using one flow guide inspection gauge 21. Therefore, it is possible to greatly reduce the shape inspection cost including a manufacturing cost of the gauge compared to a case where the shape inspection of the flow guide having the optimal shape is performed.

As described above, according to the flow guide of the exhaust hood for the steam turbine and the exhaust hood for the steam turbine according to the first embodiment of the invention, the flow guide 13 has a shape such that the meridional shapes of the flow guide are continuously changed in the circumferential direction and the portions of the flow guide 13 between the representative positions $\theta_R$ in the circumferential direction each can be shaped by the same die for plate working even if the portions of the flow guide 13 is divided into several segments in the circumferential direction. Accordingly, it is possible to achieve both high diffuser effect and low manufacturing cost.

In addition, according to the present embodiment, the circumferential distribution of the inclination angles α of the flow guide 13 is defined such that the three representative inclination angles have two different values $\alpha_1$ and $\alpha_2$ at the three representative positions $\theta_R$(180°, 90°, and 270°). Therefore, it is possible to form the three portions of the flow guide 13 between the three representative positions $\theta_R$ to be each shapes in which the pressure recovery coefficient is improved, and it is possible to form the flow guide 13 by three dies for plate working. Accordingly, it is possible to improve the diffuser effect while suppressing the manufacturing cost.

Furthermore, according to the present embodiment, the inner peripheral surface side of the representative shape that is a base shape of the meridional shapes of the flow guide 13 at respective positions θ in the circumferential direction is defined by a free curved line. Therefore, compared to a case of a representative shape defined by an arc-shaped curved line, it is possible to obtain the diffuser flow path 15 in which the pressure recovery coefficient is more improved.

Second Embodiment

Figure 10:
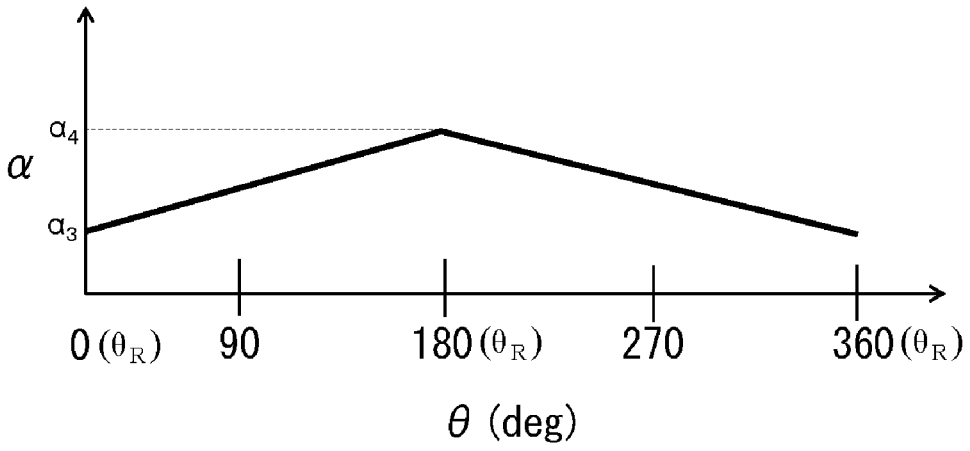
FIG. 10 is a diagram illustrating a circumferential distribution of inclination angles of the flow guide of the exhaust hood for the steam turbine according to the second embodiment of the present invention illustrated in FIG. 9.
Figure 11:
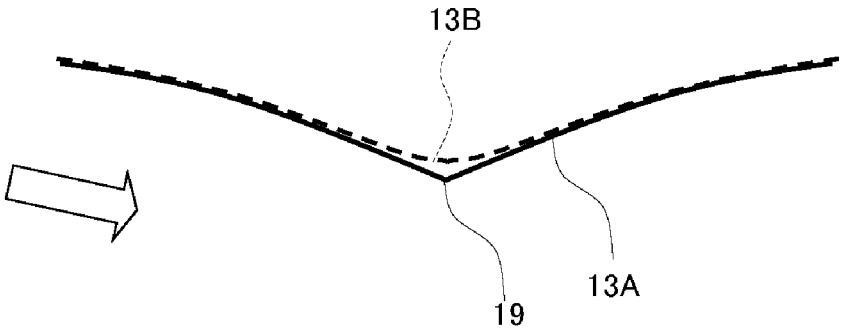
FIG. 11 is a sectional view of the flow guide of the exhaust hood for the steam turbine according to the second embodiment of the present invention, viewed from arrow XI-XI illustrated in FIG. 9.

A flow guide of an exhaust hood for a steam turbine and an exhaust hood for a steam turbine according to a second embodiment of the invention will be described with reference to FIGS. 9 to 11.

Figure 9:
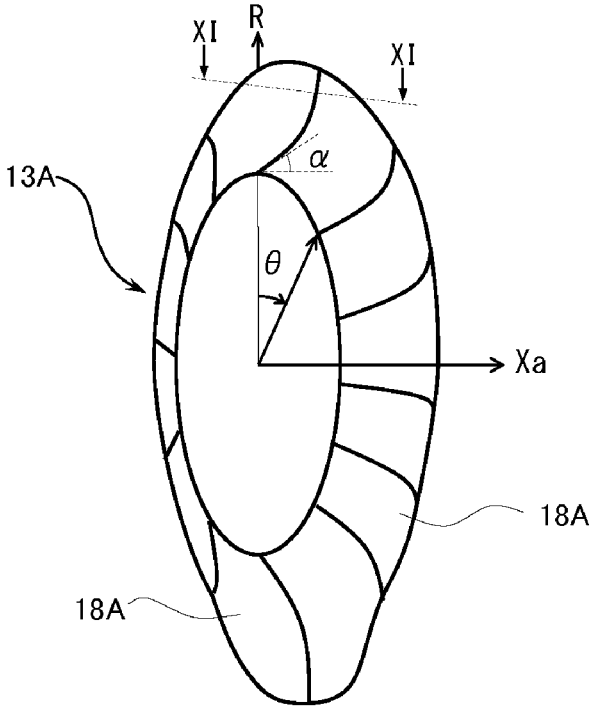
FIG. 9 is a perspective view illustrating a flow guide of an exhaust hood for a steam turbine according to a second embodiment of the present invention.

FIG. 9 is a perspective view illustrating the flow guide of the exhaust hood for the steam turbine according to the second embodiment of the invention. FIG. 10 is a diagram illustrating a circumferential distribution of inclination angles of the flow guide of the exhaust hood for the steam turbine according to the second embodiment of the invention illustrated in FIG. 9. FIG. 11 is a sectional view of the flow guide of the exhaust hood for the steam turbine according to the second embodiment of the invention viewed from arrow XI-XI illustrated in FIG. 9. In FIG. 11, a white arrow indicates a flow of steam. In FIGS. 9 to 11, the same reference numerals as those illustrated in FIGS. 1 to 8 indicate the same portions, and detailed description thereof will be therefore omitted.

In the first embodiment (see FIG. 7), the circumferential distribution of the inclination angles α of the flow guide 13 is defined such that the representative inclination angles at three representative positions $\theta_R$ (180°, 90°, and 270°) have two different values $\alpha_1$ and $\alpha_2$. In the flow guide of the exhaust hood for the steam turbine and the exhaust hood for the steam turbine according to the second embodiment of the invention, a circumferential distribution of inclination angles α of a flow guide 13A is defined such that representative inclination angles at two representative positions $\theta_R$ (0° and 180°) have two different values α3 and α4, as illustrated in FIGS. 9 and 10. Specifically, as illustrated in FIG. 10, the circumferential distribution of the inclination angles α of the flow guide 13A is defined under the condition that the representative positions $\theta_R$ of the flow guide 13A in the circumferential direction are 0° and 180°. The representative inclination angle (α4) at the later representative position $\theta_R$ is set to be relatively greater than the representative inclination angle (α3) at the former representative position $\theta_R$. Similar to the case of the first embodiment, the inclination angles of the flow guide 13A between the representative positions $\theta_R$ (0° to 180° and 180° to 360°, a right half portion and a left half portion in FIG. 9) are defined by a linear interpolation using the representative inclination angles (α3, α4) at the representative positions $\theta_R$ (0° and 180°).

The flow guide 13A having such a configuration has an inner peripheral surface (curved guide surface) that is a circumferentially continuous curved shape at any position θ in the circumferential direction. In addition, a portion (right half portion viewed from a downstream side in FIG. 9) between the representative positions $\theta_R$ from the circumferential positions θ of 0° to 180° and a portion (left half portion viewed from a downstream side in FIG. 9) between the representative positions $\theta_R$ from the circumferential positions θ of 180° to 360° each have smooth curved shapes of which first-order differentials are continuous at any position θ in the circumferential direction excluding the both ends (0° and 180°). That is, the inner peripheral surface of the flow guide 13A is a smooth curved shape in the circumferential direction excluding portions at the representative positions $\theta_R$ (0° and 180°) in the circumferential direction.

In a case where the flow guide 13A is manufactured by plate working, it is possible to form the flow guide 13A with total two dies. The inclination angles of the portion between the representative positions $\theta_R$ from the circumferential positions θ of 0° to 180° and the portion between the representative positions $\theta_R$ from the circumferential positions θ of 180° to 360° in the flow guide 13A are defined by the linear interpolation using the representative inclination angles (α3, α4) at the representative positions $\theta_R$ (0° and 180°). Therefore, each of the portions of the flow guide 13A between the representative positions $\theta_R$ (0° to 180° and 180° to 360°) can be formed by one die even if each of the portions is configured by being divided into several segments in the circumferential direction. Therefore, the flow guide 13A can be manufactured by two dies for plate working.

As described above, similar to the first embodiment, according to the flow guide of the exhaust hood for the steam turbine and the exhaust hood for the steam turbine according to the second embodiment of the invention, it is possible to achieve both the high diffuser effect and the low manufacturing cost.

In addition, according to the present embodiment, the circumferential distribution of the inclination angles α of the flow guide 13A is defined such that two representative inclination angles at two representative positions $\theta_R$ (0° and 180°) have different values α3 and α4. Therefore, it is possible to form each portion of the flow guide 13A between the two representative positions $\theta_R$ to a shape in which the pressure recovery coefficient is improved and to form the flow guide 13A by two dies for plate working. In this case, the diffuser effect may be lowered than that of the first embodiment, but it is possible to reduce the manufacturing cost more than that of the case of the first embodiment in which the flow guide can be manufactured by three dies for plate working.

In the second embodiment described above, as illustrated in FIG. 10, the flow guide 13A is formed such that the inclination angle in the vicinity of the representative position $\theta_R$ in the circumferential direction of 0° (360°) is gradually decreased toward the representative position $\theta_R$ of 0° (360°). In this case, as indicated by a solid line in FIG. 11, a portion of the flow guide 13A at the circumferential position θ of 0° (360°) has a cusp portion 19 that is pointed on the curved guide surface side (inner peripheral surface side). Meanwhile, it is ideal that steam flows out from the moving blades 2 (see FIG. 1) of the final stage without swirling in the axial direction Xa, but the swirling is inevitable on design in some cases. If the flowing-out steam swirls, the flow of the flowing-out steam is easily separated around the cusp portion 19 of the center (θ=0°) of the upper half portion of the flow guide 13A. Consequently, the diffuser performance is deteriorated.

Therefore, as a modification example of the second embodiment described above, it is possible to round the cusp portion 19 of the center (θ=0°) of the upper half portion of the flow guide 13A according to the second embodiment. That is, as indicated by a broken line in FIG. 11, an inner peripheral surface of a flow guide 13B according to the modification example of the second embodiment has a curved shape that smoothly continues at the representative position $\theta_R$ (0°) in the circumferential direction. Therefore, the flow of the flowing-out steam along the inner peripheral surface of the flow guide 13B is facilitated. Therefore, a separation scale of the diffuser flow path 15 (see FIG. 1) is suppressed and the diffuser performance is more improved.

Other Embodiments

In the first and second embodiments and the modification example thereof described above, the exhaust hood 10 for the steam turbine connected to the condenser, that is, the exhaust hood for the low pressure steam turbine is described as an example. However, the present invention can be applied to exhaust shape having similar structure for a high pressure steam turbine or an intermediate pressure steam turbine.

In addition, in the embodiments and the modification thereof described above, the example in which the circumferential distribution of the lengths r of the flow guides 13, 13A, and 13B in the radial direction R is convex upward as illustrated in FIG. 5 is described. However, the distribution may be convex downward. Moreover, the distribution may be defined by a free curved line other than the distributions that are convex upward and convex downward. Accordingly, in the embodiments and the modification thereof described above, the circumferential distribution of the length r of the flow guide in the radial direction R can be a distribution for optimizing the shape of the flow guide for each power plant.

Even if the circumferential distribution of the lengths r in the radial direction R is defined as described above, it is possible to manufacture the flow guide in low manufacturing cost. Therefore, it is possible to achieve both the high diffuser effect and the low manufacturing cost.

Furthermore, in the first embodiment described above, the example, in which the circumferential distribution of the inclination angles $\alpha$ of the flow guide 13 is defined such that the three representative inclination angles at the three representative positions $\theta_R$ (180°, 90°, and 270°) have two different values $\alpha_1$ and $\alpha_2$, is described. However, the circumferential distribution of the inclination angles $\alpha$ of the flow guide 13 may be defined such that three representative inclination angles at three representative positions $\theta_R$ have three different values.

In addition, the invention is not limited to the embodiments and includes various modifications. The embodiments described above are those described in detail to illustrate the invention clearly and are not limited to those having necessarily all described configurations. For example, it is possible to replace a part of the configurations of an embodiment to the configuration of another embodiment and may add the configuration an embodiment to another embodiment. In addition, it is possible to perform addition, deletion, and substitution of other configurations to a part of the configurations of each embodiment.

What is claimed is:

1. An exhaust hood for a steam turbine, the steam turbine comprising:

a turbine rotor; and a plurality of moving blades disposed on an outer periphery side of the turbine rotor;

the exhaust hood comprising:

a bearing cone disposable on an inner periphery side and on a downstream side of the moving blades of a final stage of the steam turbine;

an annular flow guide, having a center axis, disposable on an outer periphery side and on the downstream side of the moving blades of the final stage of the steam turbine; and an external casing surrounding the bearing cone and the flow guide, wherein meridional shapes of the flow guide at respective circumferential positions are shapes obtained by rotating one certain representative shape around an upstream end of the one certain representative shape in a meridional plane and by reducing or maintaining a radial length of the one certain representative shape, and wherein a circumferential distribution of inclination angles of an upstream end of the flow guide with respect to the center axis has representative inclination angles at respective representative positions in a circumferential direction, the circumferential distribution of the inclination angles between the representative positions being defined by a linear interpolation using the representative inclination angles at the representative positions, each of the representative positions being a position where the inclination angles change from increasing to decreasing, from decreasing to increasing, or from constant to increasing.

2. The exhaust hood for the steam turbine according to claim 1, wherein the circumferential distribution of the inclination angles has three representative inclination angles with at least two different values at three representative positions.

3. The exhaust hood for the steam turbine according to claim 1, wherein the flow guide is formed such that the inner peripheral surface side at one of the representative positions is smoothly continuous in the circumferential direction.

4. An annular flow guide for an exhaust hood for a steam turbine, the flow guide configuring a part of a diffuser flow path formed on a downstream side of final stage moving blades disposable on an outer periphery side of a turbine rotor, wherein the flow guide, having a center axis, is configured to be disposable on an outer periphery side and on the downstream side of the final stage moving blades of the steam turbine, wherein meridional shapes of the flow guide at respective circumferential positions are shapes obtained by rotating one certain representative shape around an upstream end of the one certain representative shape in a meridional plane and by reducing or maintaining a radial length of the one certain representative shape, and wherein a circumferential distribution of inclination angles of an upstream end of the flow guide with respect to the center axis has representative inclination angles at respective representative positions in a circumferential direction, the circumferential distribution of the inclination angles between the representative positions being defined by a linear interpolation using the representative inclination angles at the representative positions, each of the representative positions being a position where the inclination angles change from increasing to decreasing, from decreasing to increasing, or from constant to increasing.

* * * * *